US005978619A

United States Patent [19]

Kato et al.

[11] Patent Number: 5,978,619

[45] Date of Patent: Nov. 2, 1999

[54] IMAGE FORMING APPARATUS HAVING A CONTROL FUNCTION EMPLOYING A PLURALITY OF USER IDENTIFICATION CODES AND IMAGE FORMING METHOD EMPLOYING A PLURALITY OF USER IDENTIFICATION CODES

[75] Inventors: Tomokazu Kato, Toyokawa; Kazuo Inui, Toyohashi; Tatsuji Nozawa, Toyokawa, all of Japan

[73] Assignee: Minolta Co., Ltd., Osaka, Japan

[21] Appl. No.: 09/022,247

[22] Filed: Feb. 11, 1998

[30] Foreign Application Priority Data

Feb. 12, 1997 [JP] Japan ..... 9-028063

[51] Int. Cl.[6] ..... G03G 21/02; G03G 15/00

[52] U.S. Cl. ..... 399/80; 235/382; 399/79

[58] Field of Search ..... 399/79, 80, 81–83; 235/382.5, 382, 375

[56] References Cited

U.S. PATENT DOCUMENTS 5,608,494 3/1997 Ogura et al. ..... 399/80 X
5,610,688 3/1997 Inamoto et al. ..... 399/81 X
5,903,801 5/1999 Nakamura ..... 399/79

FOREIGN PATENT DOCUMENTS 59-091569 5/1984 Japan .
61-032862 2/1986 Japan .
62-222266 9/1987 Japan .
3-255466 11/1991 Japan .
4-321061 11/1992 Japan .
5-020470 1/1993 Japan .
6-102717 4/1994 Japan .

*Primary Examiner*—Susan S. Y. Lee
*Attorney, Agent, or Firm*—Morrison & Foerster LLP

[57] ABSTRACT

An image forming apparatus capable of controlling the conditions of use for each user by employing a user ID code and supplying identical images to multiple users by means of a simple operation, the image forming apparatus provided with a code input unit for inputting user ID codes, a number input unit for inputting the number of images to be formed for each user ID code, a processing unit for summing up the input number of images for each user ID code and setting the summed number as the number of images to be formed, and an image forming unit for forming images based on the set number of images.

12 Claims, 11 Drawing Sheets

FIG.9(a)

| area | section ID code | set copy number |
|---|---|---|
| 1 | 0001 | 2 |
| 2 | 1111 | 3 |
| 3 | 2523 | 16 |
| | | |
| | | |

FIG.9(b)

| section ID code | copy count |
|---|---|
| 0001 | |
| 0002 | |
| 0003 | |
| 0004 | |
| | |
| 1111 | |
| | |

IMAGE FORMING APPARATUS HAVING A CONTROL FUNCTION EMPLOYING A PLURALITY OF USER IDENTIFICATION CODES AND IMAGE FORMING METHOD EMPLOYING A PLURALITY OF USER IDENTIFICATION CODES

This application is based on application No. 9-28063 filed in Japan, the content of which is hereby incorporated by reference.

BACKGROUND OF THE INVENTION

1. Field of the Invention

The present invention pertains to an image forming apparatus having a control function employing a user identification code and to an image forming method employing a user identification code.

2. Description of the Related Art

Where multiple users such as different sections within a company share one or more image forming apparatuses, such as copying machines for example, in order to manage the conditions of use, such as the number of copies attributable to each section, so that costs incurred by each section may be calculated, generally an identification (ID) code is set for each section and these codes are stored in the memory of the apparatus. In an apparatus of this type, use of the apparatus is permitted by means of the user inputting this ID code, and the numbers of copies for each ID code are added up and stored in memory.

However, when this type of cost management using an ID code is performed, the following problem arises. Where copies from the same original are to be distributed among various sections, for example, the following operation must be repeatedly performed for each section: The ID code must be input, the needed amount of copies must be set, and copying must be performed, which is extremely inefficient.

SUMMARY OF THE INVENTION

The object of the present invention is to provide an improved image forming apparatus and image forming method that eliminate the problem described above.

Another object of the present invention is to provide an image forming apparatus and image forming method by means of which the conditions of use can be controlled for each user by employing an ID code, and in which identical images may be supplied to multiple users by means of a simple operation.

Said objects are achieved by providing an image forming apparatus comprising the following: a code input unit that inputs user ID codes; a number input unit that inputs the number of images to be formed for each user ID code input as described above; a processing unit that sums up the number of images for each of the multiple user ID codes and input by means of said number input unit, and sets the sum as the number of images to be formed; and an image forming unit that forms images based on the number of images set by means of said processing unit.

It is acceptable for said image forming apparatus to be equipped with a memory unit that stores the cumulative number of images formed for each user ID code, and for said processing unit of said apparatus to calculate the number of images formed by means of said image forming unit for each of said multiple user ID codes and to add the number thus calculated to the cumulative number of images for each corresponding user ID code in said memory unit. It is furthermore acceptable for said code input unit and number input unit each to comprise a numerical value input keypad mounted on said image forming apparatus.

Said objects are furthermore achieved by providing an image forming method comprising the following steps:

(1) Receive a user ID code;

(2) Receive the number of images to be formed for the user ID code received in said step (1);

(3) Receive a user ID code different from the user ID code received in said step (1);

(4) Receive the number of images to be formed for the user ID code received in said step (3);

(5) Sum up the number of images received in said steps (2) and (4), and set said sum as the number of images to be formed; and (6) Form images in accordance with the number of images set in said step (5).

It is also acceptable for said image forming method to include the following step. (7) Add the number of images formed in said step (6) for each user ID code received in said steps (1) and (3), respectively, and store in memory the added number of images.

Said objects are further achieved by providing a copying machine comprising the following: an operating station including a code input unit that inputs user ID codes and a copy number input unit that inputs the number of copies for each of the input user ID codes; a copying unit that makes copies of an original image; a memory unit that stores the cumulative number of copies made for each user ID code; and a processing unit that sums up the number of copies to be made for each of multiple user ID codes input by means of said operating station and controls said copying unit such that it makes copies based on the sum thus calculated, and that calculates the number of copies made by said copying unit for each of said multiple user ID codes and adds the number thus calculated to the cumulative number of copies made for the same user ID code stored in said memory unit.

Said objects are further achieved by providing an image forming apparatus comprising the following: a code input unit that inputs user ID codes; a processing unit that calculates the number of times that user ID codes have been input by means of said code input unit and sets the calculated number as the number of images to be formed; and an image forming unit that forms images based on the number of images set by means of said processing unit.

Said objects are furthermore achieved by providing an image forming method comprising the following steps:

(1) Receive multiple user ID codes;

(2) Calculate the number of times that user ID codes have been received in said step (1) and set the calculated number as the number of images to be formed; and (3) Form images based on the number of images set in the previous step.

BRIEF DESCRIPTION OF THE DRAWINGS

These and other objects and features of the present invention will become clear from the following description taken in conjunction with the preferred embodiments thereof with reference to the accompanying drawings, in which:

FIG. 9 comprises maps of the input section ID code memory and section copy number counter.

DETAILED DESCRIPTION OF THE PREFERRED EMBODIMENTS (First embodiment)

Figure 1:
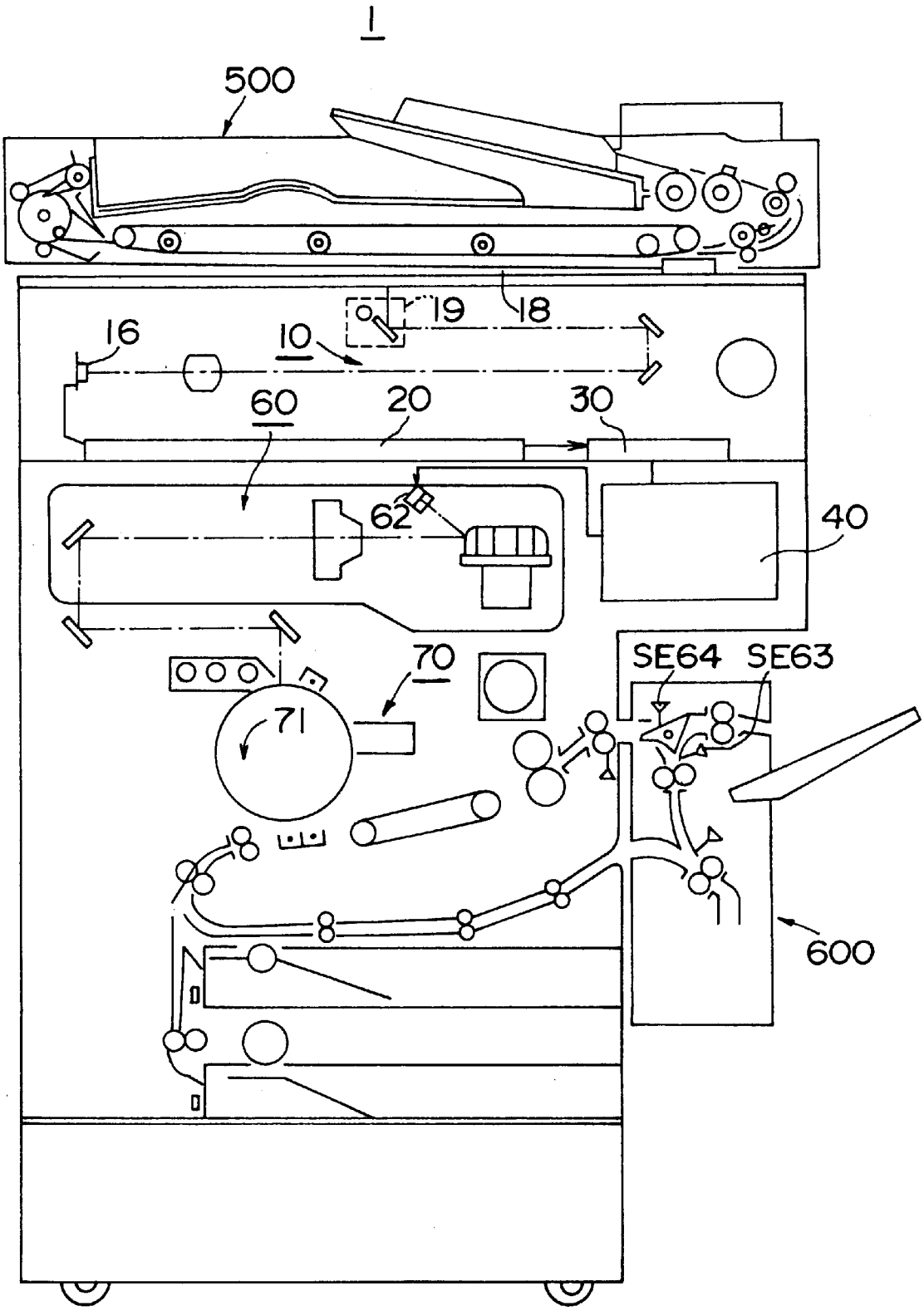
FIG. 1 is a front cross-sectional elevation showing the construction of the copying machine of the first embodiment.
Figure 2:
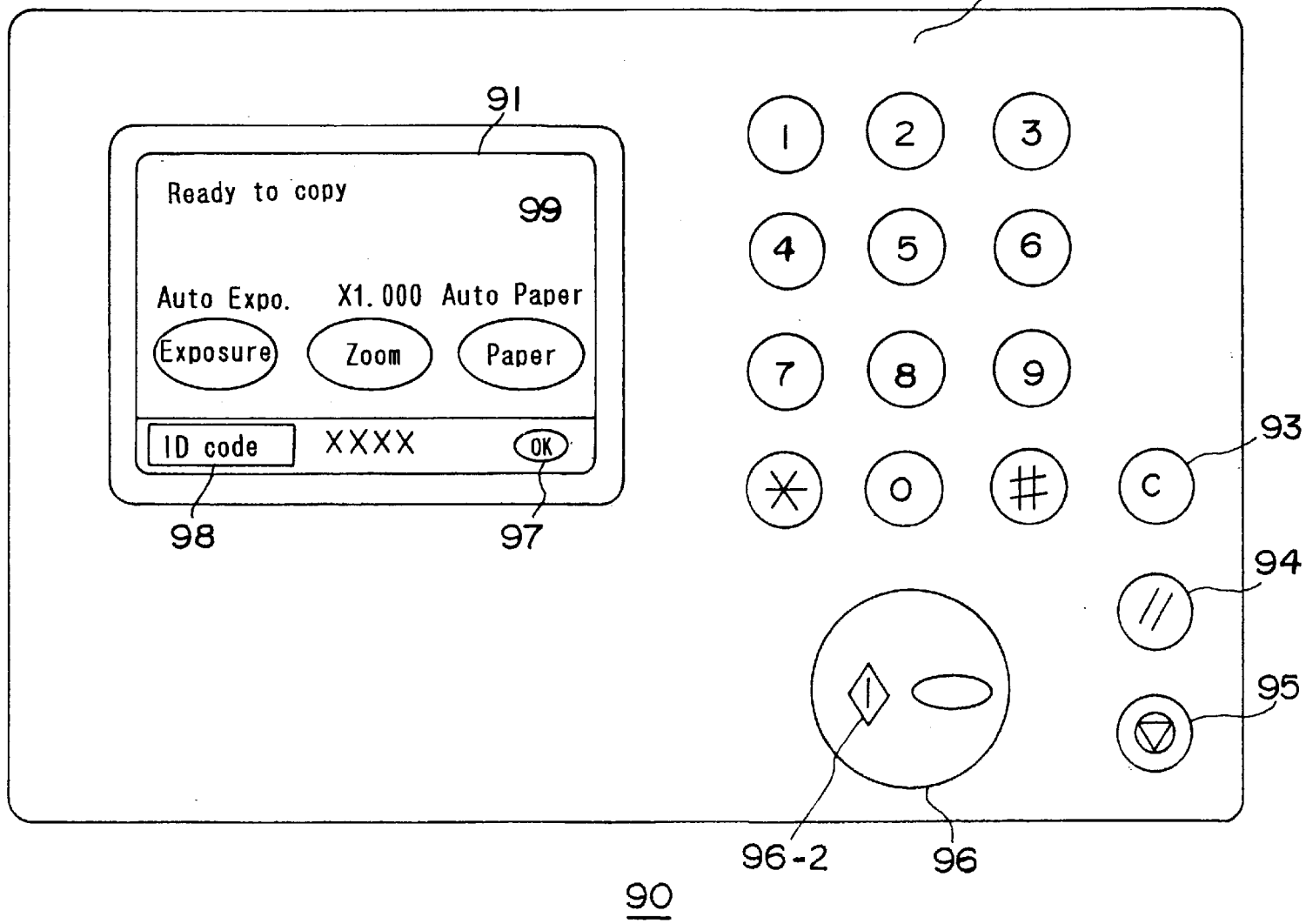
FIG. 2 is a front elevation showing the construction of the operation panel of the copying machine of the first embodiment.

The first embodiment of the present invention will be described below with reference to the drawings. FIG. 1 is a front cross-sectional elevation showing the entire construction of the copying machine in which the present invention is applied. FIG. 2 is a front elevation of the operation panel of said copying machine.

In FIG. 1, copying machine 1 comprises mainly scanning system 10, image signal processor 20, memory unit 30, print processor 40, laser optical system 60 and image forming system 70.

Scanning system 10 reads an original image, converts it to image signals, and sends the signals to image processor 20. Image signal processor 20 processes the image signals sent from scanning system 10 and outputs them to memory unit 30. Memory unit 30 either sends the image data input from image signal processor 20 to print processor 40 as is, or alternatively, stores it in memory. Print processor 40 drives semiconductor laser 62 based on the image data input from memory unit 30. Laser optical system 60 guides the laser light from semiconductor laser 62 to a prescribed exposure position on photoreceptor drum 71. Image forming system 70 develops the electrostatic latent image formed on photoreceptor drum 71 via said laser irradiation into a toner image by means of toner, and after this toner image is transferred to a sheet of recording paper, the image is fused to the sheet and thereby formed.

Operation panel 90 (see FIG. 2) is located at the front part of the top surface of copying machine 1. Auto document feeder 500, which automatically feeds the original to the reading position and automatically ejects it after reading is completed, and paper re-send/flip-over device 600, which reverses the sheet of recording paper that has received image formation on one side and either supplies it for image formation once more or ejects it, are mounted to copying machine 1 where necessary.

The image forming operation of copying machine 1 having the construction described above will be explained in a simple fashion below.

By performing optical scanning of an original document located on platen glass 18 by means of scanner 19 of said scanning system 10, the original image is read by photoelectric conversion element 16 and image signals are output. After undergoing prescribed processing by means of image signal processor 20, the image signals output from photoelectric conversion element 16 are sent to memory unit 30. Memory unit 30 outputs the image signals thus received to print processor 40 either without further processing or after temporarily storing them in memory.

Regarding storage of the image data to memory and reading out of the image data from memory by means of memory unit 30, in one image forming operation, the images sequentially read of the originals are stored in the order of the pages, and are then read out of memory in the order of the pages in accordance with a prescribed timing sequence. Where multiple copies are to be made, the reading out from memory in the order of the pages is repeated for the number of copies.

Because most of the components of the construction shown in FIG. 1 are in the public domain, their detailed explanation here will be omitted.

FIG. 2 is a front elevation showing the construction of operation panel 90. Located on operation panel 90 are liquid crystal touch panel 91, keypad 92 to input numerical data such as the number of copies or the section ID code, clear key 93 to return the set value for such things as the number of copies to the default value of 1, reset key 94 to return the copying conditions set in the copying machine to the default conditions, stop key 95 to stop the copy operation, and print key 96 to begin the copy operation. LED 96-2 is located inside print key 96 to display a green light to indicate that the copying machine can receive a print command or a red light to indicate that the copying machine cannot receive a print command.

Liquid crystal touch panel 91 comprises a touch panel laminated onto a flat liquid crystal display. Touch panel 91 not only displays set parameters such as the copy darkness, the magnification and the copy paper size, malfunction information such as the occurrence of a paper jam, and other information such as warnings regarding the need for a service call or the need to refill the paper tray, but also displays OK key 97 to confirm data input, section ID code key 98 to call up the input screen to input the user ID code (in this embodiment, the section ID code within an organization such as a company), as well as various touch keys to call up various setting screens such as those for setting the copy darkness, the magnification and the copy paper size. These touch keys are turned ON by the user by touching them with a finger, etc., at the various touch key positions on liquid crystal touch panel 91.

Figure 3:
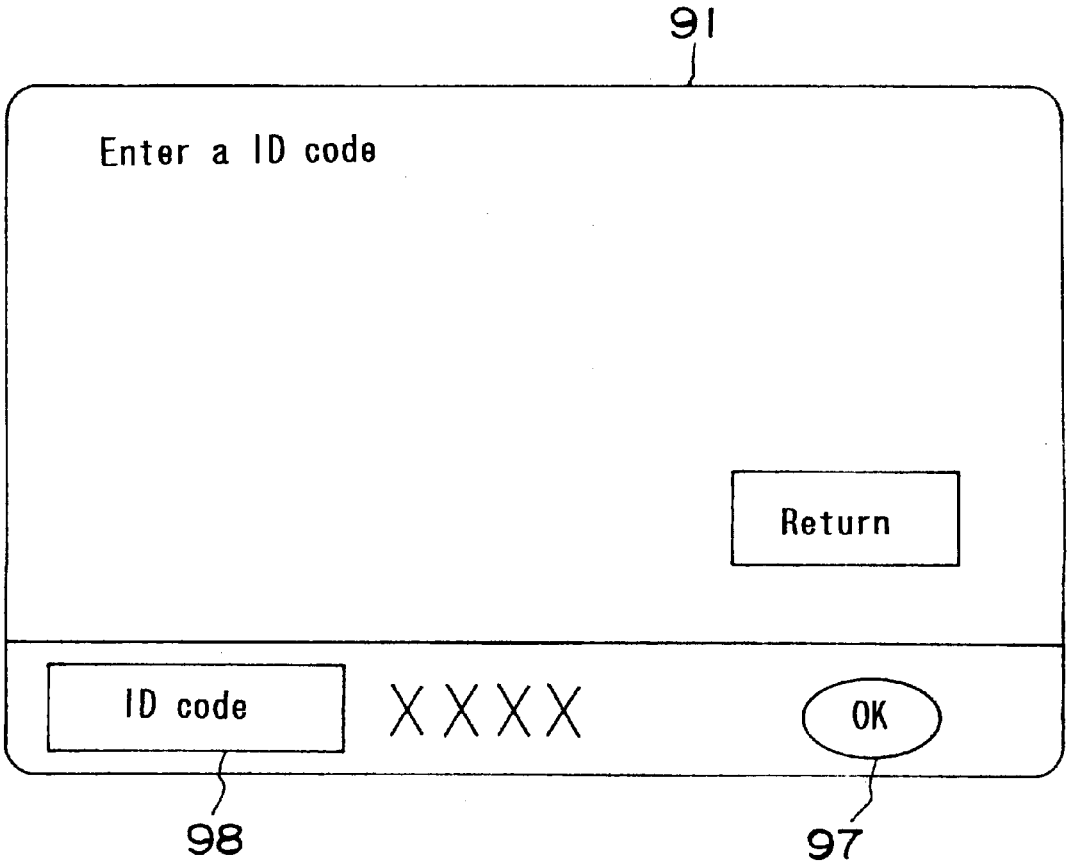
FIG. 3 is a drawing showing the section ID code input screen.

For example, where a section ID code is to be input, section ID code key 98 on liquid crystal touch panel 91 is touched. When this is done, the panel display changes to the section ID code input screen shown in FIG. 3. When this section ID code input screen is displayed, if a section ID code is input using keypad 92, the number input is displayed on a display area (located to the right of section ID code key 98 in FIG. 3). After this occurs, if OK key 97 is touched, the input is confirmed and the number input is set as the section ID code. Where the number is to be changed, the number may be input once more after pressing clear key 93 on operation panel 90 and resetting the input number.

Figure 4:
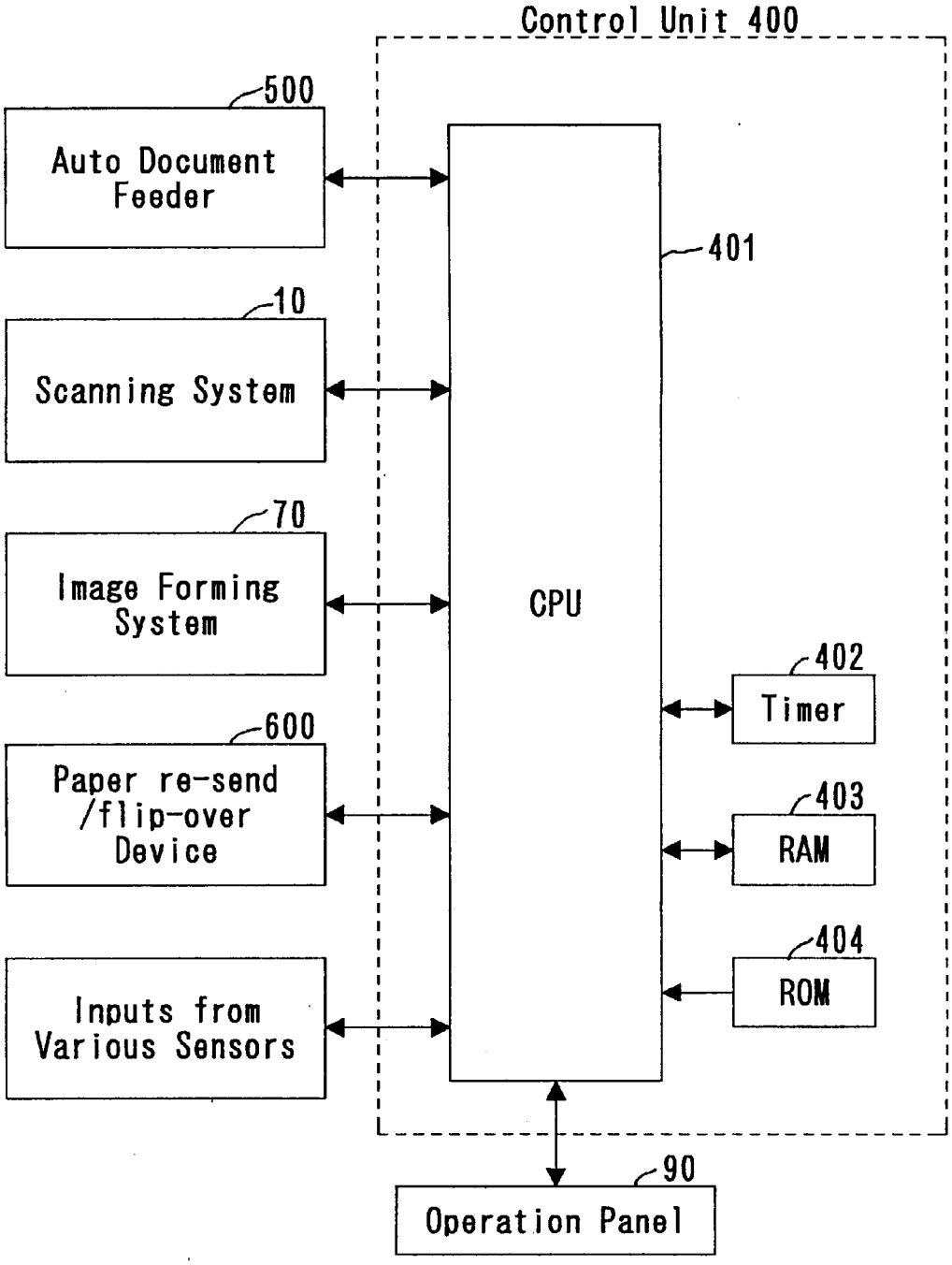
FIG. 4 is a block diagram showing the construction of the control unit of the copying machine of the first embodiment.

FIG. 4 is a block diagram showing the construction of control unit 400 mounted inside copying machine 1.

As shown in the drawing, this control unit 400 comprises CPU 401, timer 402, RAM 403 and ROM 404.

Timer 402 performs clocking for timing control for the processing routines. RAM 403 stores the number of copies and other copying conditions set by means of operation panel 90, and also functions as an input section ID code memory and section copy number counter to be described below. Control programs needed for the copy operation and the initial set values are stored beforehand in ROM 404.

CPU 401 calls up the necessary control program from ROM 404 based on instructions from operation panel 90, obtains a successful copy operation by controlling the operations of said auto document feeder 500 and of scanning system 10, image forming system 70 and paper re-send/flip-over device 600, etc., of copying machine 1, and also controls the display screens, etc. of liquid crystal touch panel 91 of operation panel 90.

Next, the control routine for copying machine 1 will be explained with reference to the flow charts shown in FIGS. 5 through 8 and the input section ID code memory map and the section copy number counter map shown in FIGS. 9(*a*) and 9(*b*), respectively.

Figure 5:
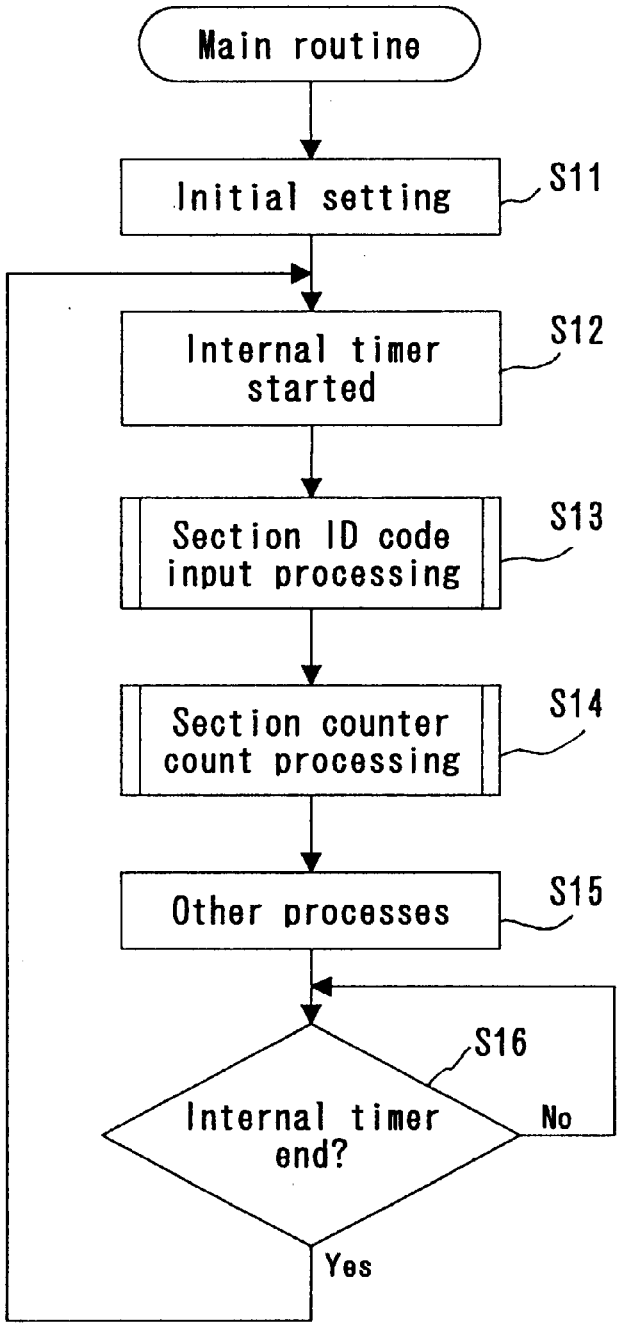
FIG. 5 is a flow chart of the main routine for the control of the copying machine of the first embodiment.

FIG. 5 is a flow chart of the main routine executed by means of control unit 400 of copying machine 1.

For example, when the routine is started by turning ON the power to copying machine 1, first, initial setting operations such as the resetting of the registers in CPU 401 and the clearing of RAM 403 are performed (step S11), and the internal timer to control the time of execution of one routine is set, whereupon clocking is begun (S12). Next, section ID code input processing (S13) and section counter count processing (S14) are performed, whereupon other processes are performed (S15). When the internal timer completes its operation, the routine returns to step S12, concluding one routine.

The other processes referred to above include input of various instructions from operation panel 90, display on operation panel 90, and control of the image formation process.

Figure 6:
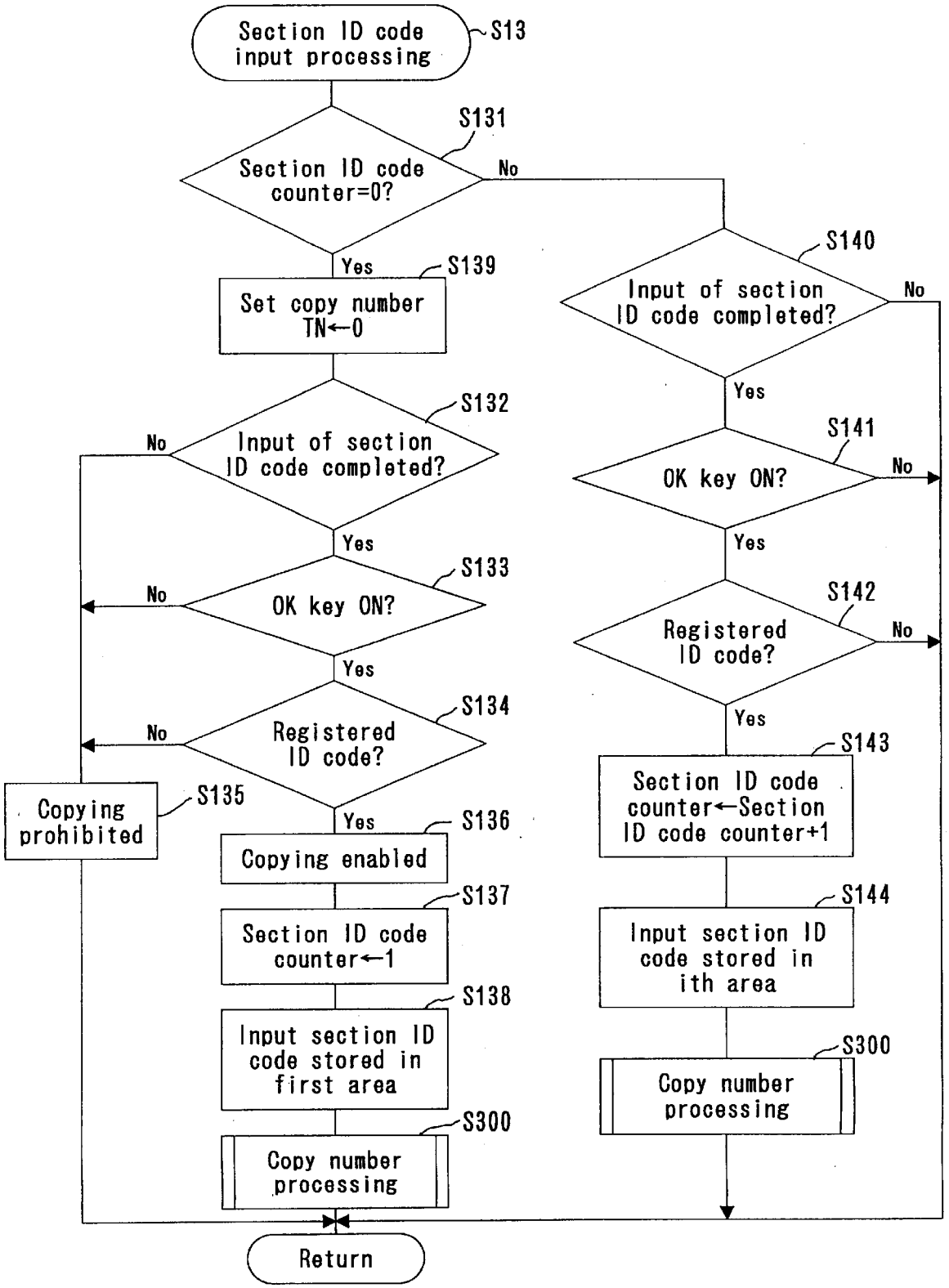
FIG. 6 is a flow chart of the section ID code input subroutine.

FIG. 6 is a flow chart of the section ID code input processing subroutine (S13) of the main routine shown in FIG. 5.

In the section ID code input processing subroutine, it is first determined whether or not the section ID code counter value is 0 (S131). This section ID code counter counts the number of section ID codes input.

Where the section ID code counter value is 0 (YES in S131), i.e., where the input section ID code is the first code input, set copy number TN is set to 0 (S139). The copy operation is then enabled (S136) on the following conditions: (1) input of the numerical section ID code (consisting of four digits in this embodiment) is completed, (2) the input section ID code is confirmed and set through the pressing of OK key 97, and (3) the set section ID code is among the section ID codes registered beforehand (YES in S132, S133 and S134). If any of said conditions are not met (NO in any of S132, S133 or S134), copying is prohibited (S135), and the routine returns to the main routine of FIG. 5. When this occurs, processing to illuminate LED 96-2 of the print key in red is performed in the step for 'other processes' in the main routine (S15). Alternatively, if copying is enabled (S136), '1' is input to said section ID code counter (S137), the input section ID code is stored in the first area of the input section ID code memory shown in FIG. 9(*a*) (S138), and copy number processing is performed (S300). Copy number processing will be described in detail below.

On the other hand, if the section ID code counter is other than 0, (NO in S131), i.e., if this is the second or more time that a section ID code has been input, it is determined whether or not (1) numerical section ID code input from operation panel 90 has been completed (S140), (2) the input section ID code has been confirmed and set by means of OK key 97 (S141), and (3) the set section ID code is among the section ID codes registered beforehand (S142), and if the answer to any of these determinations is NO, the routine returns to the main routine of FIG. 5 without performing further processing.

If the answers obtained in steps S141, S142 and S143 are all YES, the section ID code counter value is increased by 1 (S143), the input section ID code is stored in the ith area of the input section ID code memory shown in FIG. 9(*a*) (where it is the second section ID code input, i=2, where it is the third section ID code input, i=3, and so on), and copy number processing is performed (S300).

Figure 7:
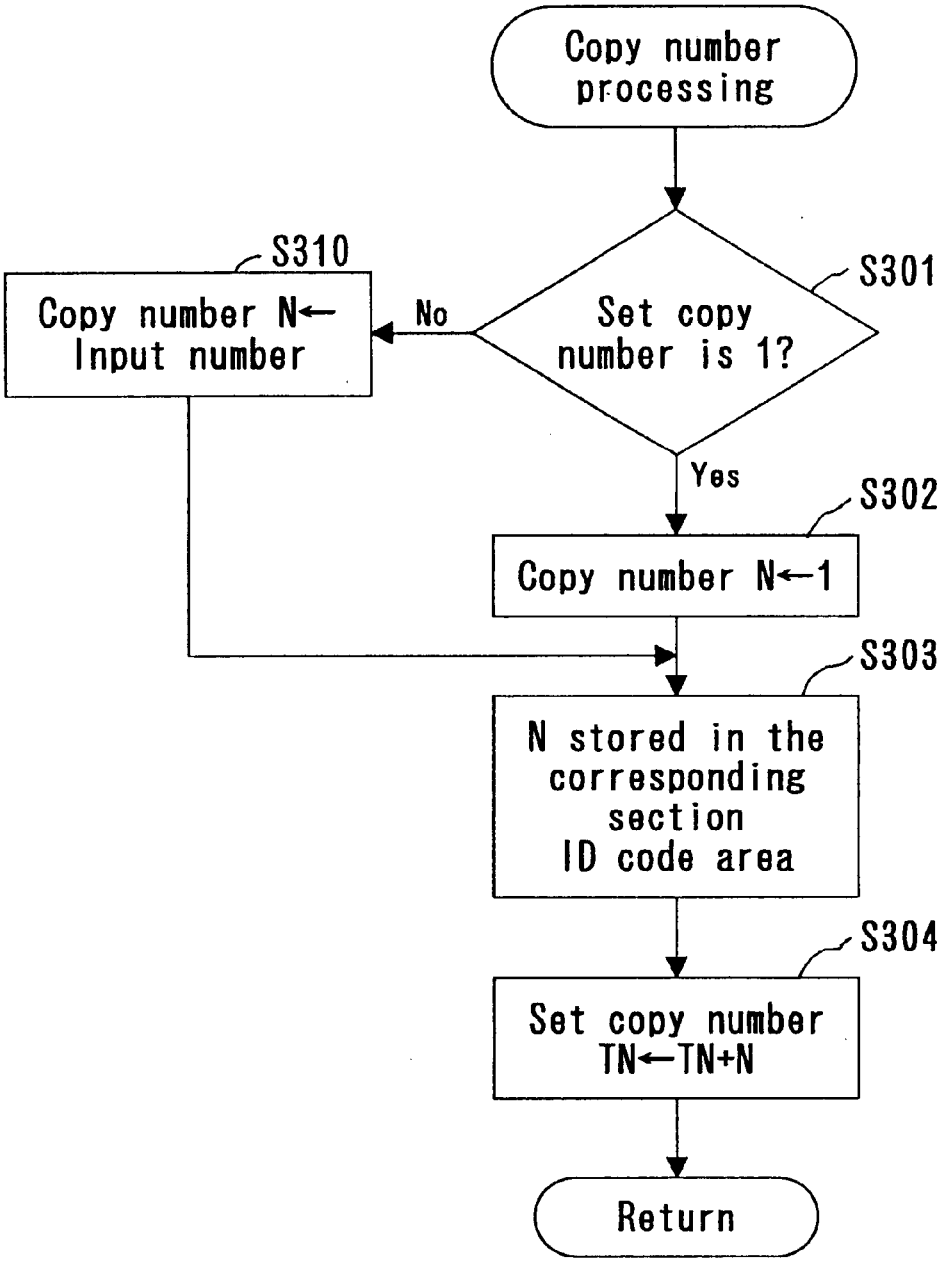
FIG. 7 is a flow chart of the copy number control subroutine.

FIG. 7 is a flow chart of the copy number processing subroutine.

First, the numerical value set as the copy number by means of keypad 92 of operation panel 90 is checked, and if the input value is 1 (YES in S301), '1' is substituted for copy number N (S302), whereas if the input value is not 1, (NO in S301), the input value is substituted for copy number N (S310). Next, copy number N is stored in the corresponding section ID code area of the input section ID code memory shown in FIG. 9(*a*) (S303), and subsequently the sum of set copy number TN and copy number N is substituted for set copy number TN (see S139 in FIG. 6) (S304), whereupon the routine returns to the main routine.

By means of the subroutine described above, the number of copies to be made for each section ID code in one copy operation and the total of the numbers of copies to be made for various section ID codes are calculated and stored in memory in response to the input and setting of section ID codes and the numbers of copies for each of said section ID codes.

Figure 8:
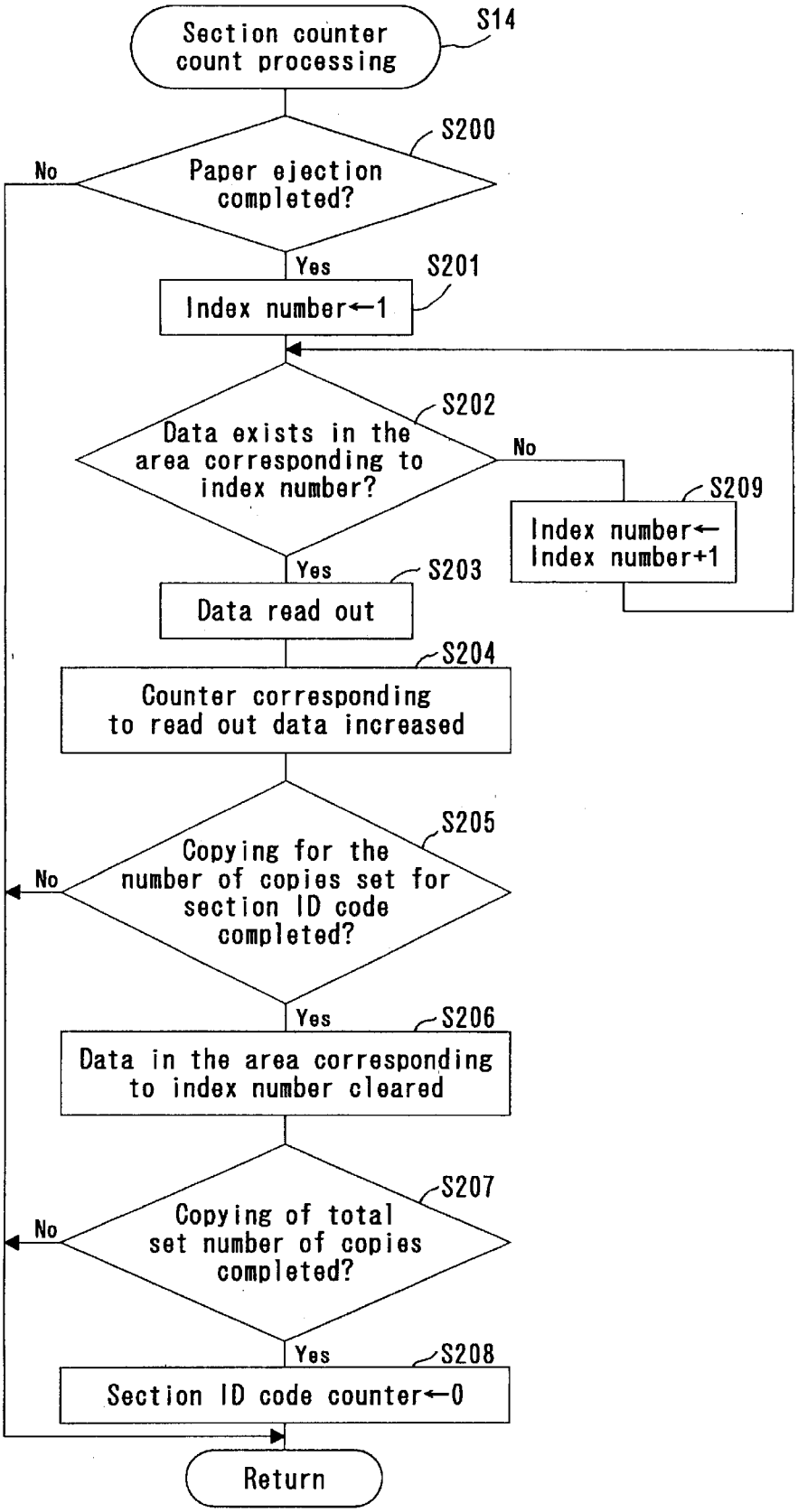
FIG. 8 is a flow chart of the count subroutine performed by the section counter.

FIG. 8 is a flow chart of the section counter count processing subroutine (S14) of the main routine shown in FIG. 5.

In this subroutine, it is first determined whether or not a sheet of recording paper on which an image has been formed has been ejected from the machine (S200). This determination is performed through the detection of the off-edges of the output signals from eject sensor SE63 and flip-over/eject sensor SE64 in FIG. 1.

Where ejection of the recording paper is confirmed (YES in S200), the index number for the input section ID code memory area shown in FIG. 9(*a*) is set to '1' (S201), and it is determined whether or not data exists in the area corresponding to the index number (S202). If it is determined here that data does not exist in the area corresponding to the index number (NO in S202), 1 is added to the index number (S209), and the existence or non-existence of data is determined once again (S202). If it is determined that data does exist in the area corresponding to the index number (YES in S202), the data (section ID code) is read out (S203) and the corresponding counter (see FIG. 9(*b*)) is increased by 1 (S204). The processes of steps S200 through S204 are then repeated until the set copy number for the indexed section ID code (see FIG. 9(*a*)) and the count value for the counter corresponding to said section ID code become identical, i.e., until the copying for the number of copies set for said section ID code is completed. When copying for the number of copies set for said section ID code is completed (YES in S205), the data in the area corresponding to said index number is cleared (S206), and it is determined whether or not copying of the total set number of copies (set copy number TN) has been completed (S207).

Where copying of the total set number of copies has not been completed (NO in S207), the processes of steps S200 through S206 and step S209 are repeated in order to perform processing for the section ID code in the next area. In other words, it is determined once more whether or not the recording paper has been ejected (S200), and if it has been ejected, the index number is set to 1, and it is determined whether or not data exists in that area (S201, S202). For example, when this processing takes place the second time around, because the data in the area corresponding to index number 1 is cleared in step S206 and does not exist (NO in S202), the index number is increased by 1 and the data for the next area is confirmed. In this way, the processes of steps S202 and S209 are repeated until existence of the data is confirmed. If the data (section ID code) does exist in the area corresponding to the index number (YES in S202), the count of the counter corresponding to said section ID code is increased in the same manner as described above (S203 through S205).

Said processes are repeatedly performed until copying for the total set number of copies is completed. When the copying for the total set number of copies has been completed (YES in S207), the section ID code counter is reset (S208), and the routine returns to the main routine.

By means of the routines described above, the number of copies made in one copy operation can be calculated for each section and stored in memory.

In other words, using copying machine 1 of the present embodiment, even where copies are made for multiple sections in a single copy operation, the cumulative number of copies for each section can be calculated and stored in memory. As a result, the need to calculate the costs attributable to each section can be met, and the burden on the operator can be reduced at the same time.

(Second embodiment)

The second embodiment of the present invention will be explained below. In this embodiment, the section code input processing subroutine and the section counter count processing subroutine used in copying machine 1 of said first embodiment are changed. All other constructions and control routines are identical to those of the copying machine of the first embodiment, and therefore only the parts that differ will be explained here.

Figure 10:
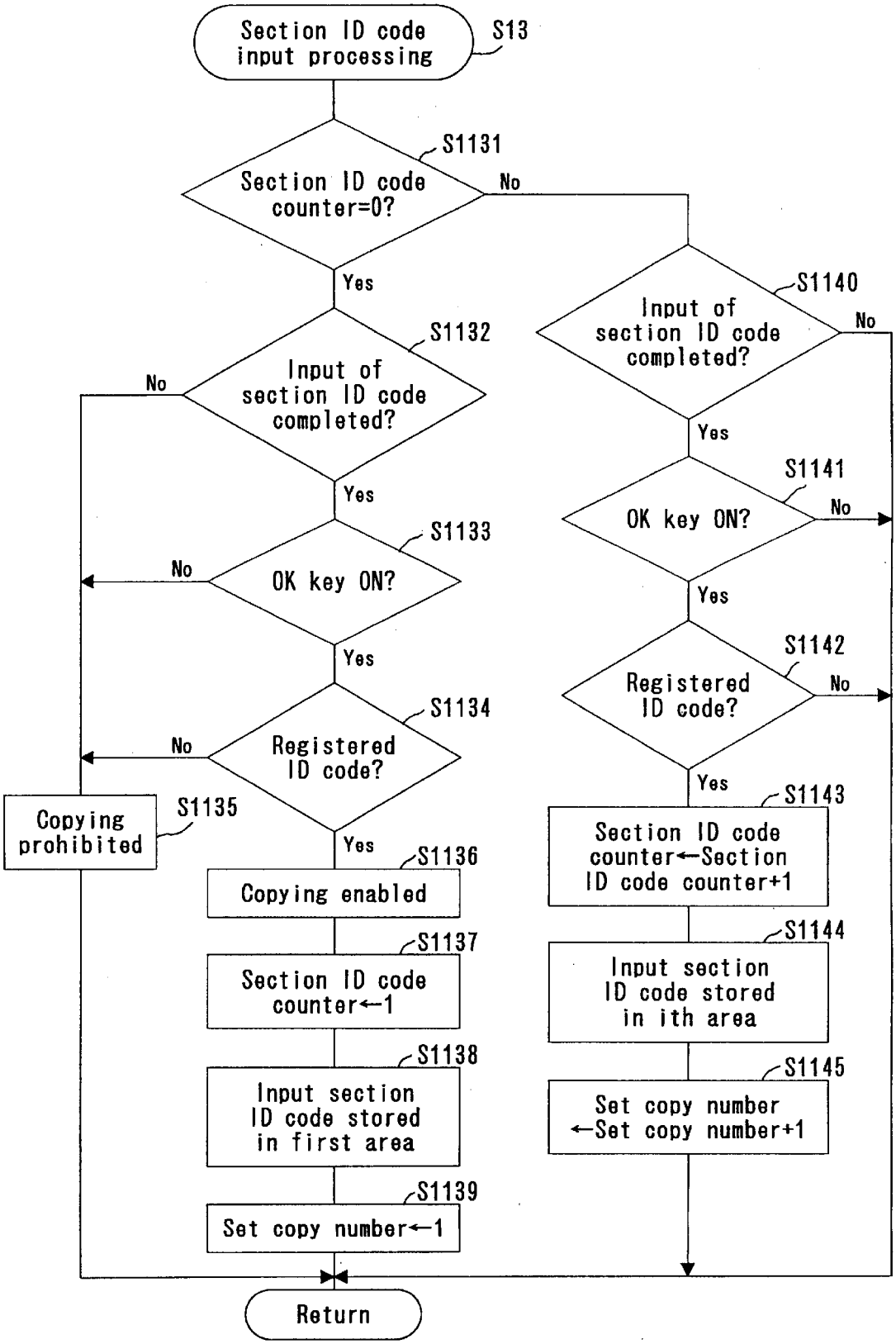
FIG. 10 is a flow chart of the section ID code input control subroutine of the second embodiment.

FIG. 10 is a flow chart of the section ID code input processing subroutine of the second embodiment. Many of the processes used in this subroutine are identical to those used in the section ID code input processing subroutine for the first embodiment (FIG. 6). What is different here is that there is no process for inputting a number of copies to set said number for each section ID code. Therefore, in this embodiment, a single copy is made for each section ID code.

In other words, section ID codes are input using operation panel 90, and each time one is set, it is stored in sequence in the input section ID code memory shown in FIG. 9(*a*) (S1138, S1144). The number of copies to be made is increased by one each time a section ID code is stored in memory (S1139, S1145). In other words, in this embodiment, a number of copies which is equal to the number of section ID code inputs is set as the total number of copies to be made in one copy operation.

Figure 11:
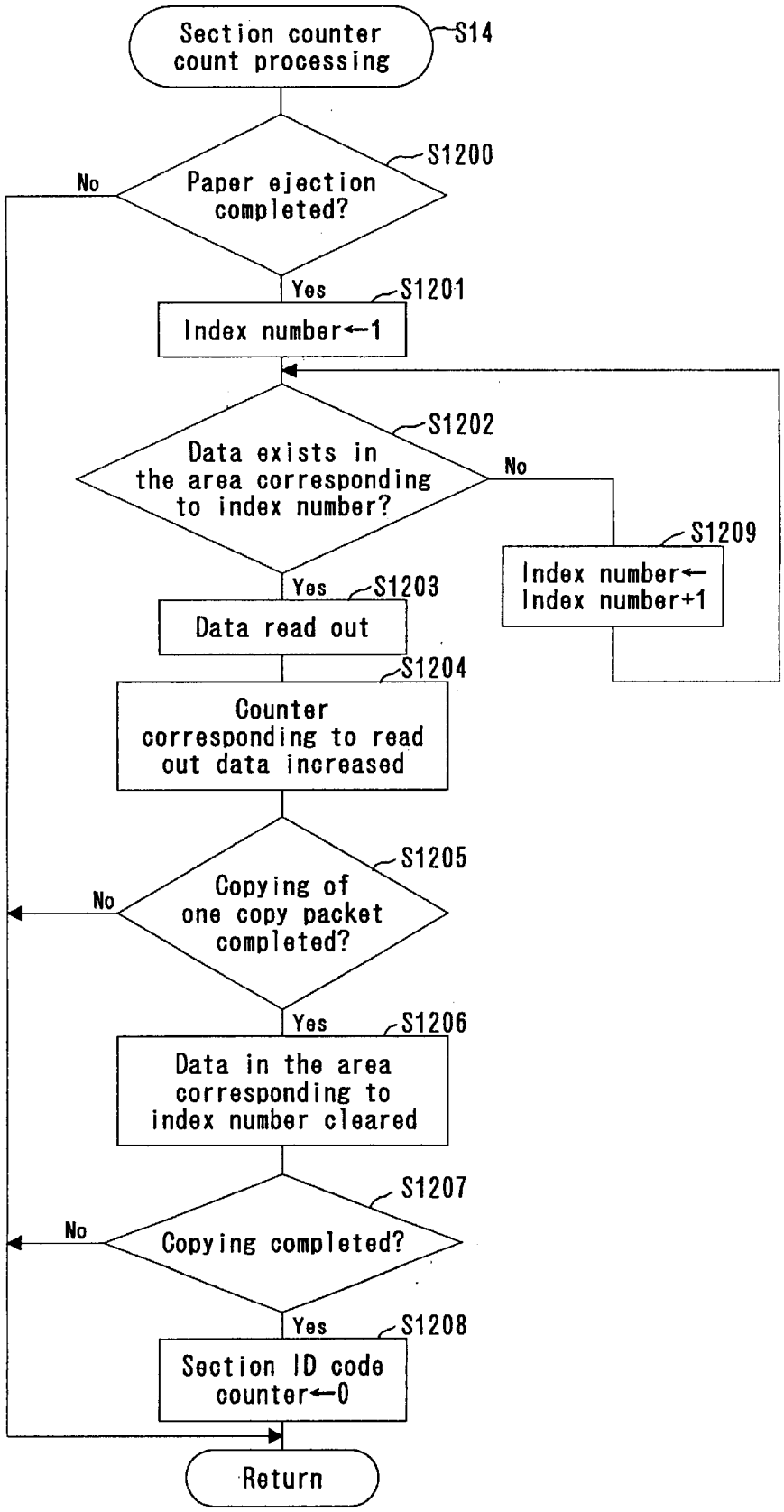
FIG. 11 is a flow chart of the count subroutine performed by the section counter in the second embodiment.

FIG. 11 is a flow chart of the section counter count processing subroutine of this embodiment. In this subroutine as well, most of the processes are identical to those of the section counter count processing subroutine used in the first embodiment (FIG. 8). What is different here is the process of step S1205, which is equivalent to the process of step S205 in FIG. 8. In step S1205, it is determined whether or not copying of the number of sheets comprising one copy packet has been completed.

In other words, in this second embodiment, one copy is made for each section in one copy operation, and the number of sheets comprising one copy packet is added to the cumulative number of copies for each section.

Although the present invention has been fully described in connection with the preferred embodiments thereof with reference to the accompanying drawings, it is to be noted that various changes and modifications are apparent to those skilled in the art. Such changes and modifications are to be understood as included within the scope of the present invention as defined by the appended claims unless they depart therefrom.

For example, in the embodiments described above, the section ID code is input by means of the operation panel on the copying machine, but it is acceptable to treat the information taken from the card by a card scanner connected to the copying machine as the section ID code. In this case, for example, inputting of the number of copies for each section may also be performed in accordance with the number of times scanning is performed.

Furthermore, where the copying machine is connected to a network, the section ID code may be input by means of the network.

Moreover, in these embodiments, the section ID code is a numerical value comprising four digits, but the number of digits is not limited to four, and the code itself is not limited to a numerical value. In addition, the user is not limited to a section of a business organization, and any group or individual may be set to be the user.

Furthermore, the matter controlled by means of the ID code need not be limited to the number of copies, but may also be an amount of money to be charged for the copies. The counting may also be adjusted according to the size of the original document, the size of the recording paper, etc.

In these embodiments, the explanations used the example of a digital copying machine, but the present invention may naturally be applied in an analog copying machine as well. The present invention can also be applied not only in a copying machine, but in other image forming apparatuses including printers.

What is claimed is:

1. An image forming apparatus comprising:

a code input unit for inputting a plurality of user ID codes before image formation;

a number input unit for inputting a number of images to be formed for each of the plurality of user ID codes input into said code input unit;

a processing unit for summing up the number of images for each of the plurality of user ID codes input into said number input unit and for setting a summed number as a number of images to be formed; and an image forming unit for forming images based on the number of images set by said processing unit.

2. An image forming apparatus as claimed in claim 1, further comprising a memory unit for storing a cumulative number of images formed for each of the plurality of user ID codes, wherein said processing unit calculates the number of images formed by said image forming unit for each of the plurality of user ID codes and adds the number thus calculated to the cumulative number of images for each corresponding user ID code in said memory unit.

3. An image forming apparatus as claimed in claim 1, wherein each of said code input unit and said number input unit comprises a numerical value input keypad mounted on said image forming apparatus.

4. A method of forming images comprising the steps of:

(1) receiving a first user ID code;

(2) receiving a first number of images to be formed for the first user ID code;

(3) receiving a second user ID code different from the first user ID code;

(4) receiving second number of images to be formed for the second user ID code;

(5) summing up the first and second numbers of images to be formed and setting the summed number as a total number of images to be formed; and (6) forming images based on the total number of images to be formed set in step (5), wherein the steps are performed successively.

5. A method as claimed in claim 4, further including the following step:

(7) calculating a number of images formed in step (6) for each of the first and second user ID codes and storing in memory the calculated number of images formed for each of the first and second user ID codes.

6. A copying machine comprising:

an operating station including a code input unit for inputting a plurality of user ID codes and a copy number input unit for inputting a number of copies to be made for each of the plurality of user ID codes input into said code input unit before copies of an original image are made;

a copying unit for making copies of the original image;

a memory unit for storing a cumulative number of copies made for each of the plurality of user ID codes; and a processing unit for summing up the number of copies for each of the plurality of user ID codes input through said operating station and for controlling said copying unit such that it makes copies based on the summed number of copies, and for calculating the number of copies made by said copying unit for each of the plurality of user ID codes and for adding the number thus calculated to the cumulative number of copies for each corresponding user ID code in said memory unit.

7. A copying machine as claimed in claim 6, wherein each of said code input unit and said copy number input unit comprises a numerical value input keypad mounted on said copying machine.

8. An image forming apparatus comprising:

a code input unit for inputting a plurality of user ID codes before image formation;

a processing unit for calculating a number of times which the plurality of user ID codes have been input into said code input unit and for setting the calculated number as a number of images to be formed; and an image forming unit for forming images based on the number of images set by said processing unit.

9. An image forming apparatus as claimed in claim 8, further comprising a memory unit for storing a cumulative number of images formed for each of the plurality of user ID codes, wherein said processing unit calculates the number of images formed by said image forming unit for each of the plurality of user ID codes and adds the number thus calculated to the cumulative number of images for each corresponding user ID code in said memory unit.

10. An image forming apparatus as claimed in claim 8, wherein said code input unit comprises a numerical value input keypad mounted on said image forming apparatus.

11. A method of forming images comprising the steps of:

(1) receiving a plurality of user ID codes before image formation;

(2) calculating a number of times which the plurality of user ID codes have been received in step (1) and setting the calculated number as a total number of images to be formed; and (3) forming images based on the total number of images to be formed.

12. A method as claimed in claim 11, further including the following step:

(4) calculating a number of images formed in step (3) for each of the plurality of user ID codes and storing in memory the calculated number of images formed for each of the plurality of user ID codes.

* * * * *